US005923322A

United States Patent [19]

Kim

[11] Patent Number: 5,923,322

[45] Date of Patent: Jul. 13, 1999

[54] ENHANCED FEATURE CONNECTOR FOR AN OVERLAY BOARD

[75] Inventor: Sang-Moo Kim, Kyungki-do, Rep. of Korea

[73] Assignee: SamSung Electronics Co., Ltd., Kyungki-do, Rep. of Korea

[21] Appl. No.: 08/727,091

[22] Filed: Oct. 7, 1996

[30] Foreign Application Priority Data

Oct. 10, 1995 [KR] Rep. of Korea ..... 95-34698

[51] Int. Cl.[6] ..... G09G 5/00

[52] U.S. Cl. ..... 345/204; 345/150; 345/132; 345/113

[58] Field of Search ..... 345/112, 113, 345/114, 132, 150, 154, 155, 204, 205, 206, 211, 212, 213

[56] References Cited

U.S. PATENT DOCUMENTS 4,800,423 1/1989 Appiano et al. .
4,855,831 8/1989 Miyamoto et al. .
4,878,181 10/1989 MacKenna et al. .
4,942,391 7/1990 Kikuta .
4,954,970 9/1990 Walker et al. .
5,093,798 3/1992 Kita .
5,254,984 10/1993 Wakeland .
5,546,518 8/1996 Blossom et al. .
5,644,333 7/1997 King et al. ..... 345/113

*Primary Examiner*—Xiao Wu
*Attorney, Agent, or Firm*—Robert E. Bushnell, Esq.

[57] ABSTRACT

An enhanced feature connector for an overlay board transmits and receives digital data from a video graphics array (VGA) feature connector and analog data from a video graphics array connector using a single connector. The overlay board uses an enhanced feature connector for receiving both video graphics array digital feature data and analog red, green, blue (R.G.B.) data from a video graphics array board; an overlay controller for receiving digital data such as pixel data, pixel clock, horizontal synchronization, and vertical synchronization from a digital feature connector portion of the enhanced feature connector, converting the digital data into analog red, green and blue data, and generating overlay red, green and blue data; an analog multiplexer (MUX) for sequentially selecting both an input signal of analog red, green and blue data of the overlay controller and an input signal of analog red, green and blue data of a video graphics array board (not shown), dividing the input signals, and selecting a signal corresponding to each input signal; and a monitor connector for receiving output data from both the analog multiplexer and the enhanced feature connector, and for outputting the output data to a monitor.

6 Claims, 5 Drawing Sheets

ENHANCED FEATURE CONNECTOR FOR AN OVERLAY BOARD

CLAIM OF PRIORITY

This application makes reference to, incorporates the same herein, and claims all benefits accruing under 35 U.S.C. §119 from an application for A DEVICE OF ENHANCED FEATURE CONNECTOR FOR OVERLAY BOARD earlier filed in the Korean Industrial Property Office on Oct. 10, 1995 and there duly assigned Serial No. 34698/1995.

BACKGROUND OF THE INVENTION

1. Field of the Invention

The present invention relates to an enhanced feature connector for an overlay board. More particularly, it relates to an enhanced feature connector for an overlay board which transmits and receives digital data from a video graphics array feature connector and analog data from a video graphics array connector by using a single connector.

2. Description of the Related Art

An earlier connection of a feature connector and an overlay board was usually constructed with a video graphics array board for outputting a video signal to an output unit having a graphics control large scale integration (LSI) unit including a video graphics array unit which is requisite for generation of a video signal transmitted to a video display through cables; a feature connector for transmitting and receiving a video graphics array digital video signal which is generally used to overlay other signals; an overlay board for overlaying another video signal on a current operating program; and an analog connector 120 for transmitting analog video red (R), green (G), and blue (B) data signals outputted from the video graphics array board.

The overlay board received digital pixel data from the video graphics array feature connector of the video graphics array board as an input and received an analog video red, green and blue data signal from the video graphics array monitor connector as an input.

Typically, such overlay boards receive both the digital pixel data and the red, green and blue data signal, and generate a signal mixed by an internal circuit, and outputs the mixed signal to a monitor.

The earlier designs for overlay boards often included a feature connector for transmitting and receiving a video graphics array digital video signal used for overlaying other signals; a connector for receiving analog red, green and blue data from a video graphics array board as an input; an overlay controller for receiving digital signals such as pixel data, pixel clock, horizontal synchronization, and vertical synchronization and converting the digital signals into analog red, green and blue data in order to overlay video signals by loading plural display windows; an analog multiplexer (MUD for sequentially selecting both an input signal of analog red, green and blue data of the overlay controller and an input signal of analog red, green and blue data of a video graphics array board, dividing the input signals, and selecting a signal corresponding to each input signal; and a connector for transmitting output data from the analog multiplexer to a monitor.

The earlier overlay board received video graphics array data from a video graphics array board, combined the video graphics array data with the conventional overlay board's signal and finally applied the combined data to drive a monitor.

There are two kinds of paths for receiving a signal from the video graphics array board: digital signals such as a pixel data, pixel clock, horizontal synchronization signal, and vertical synchronization signal from the video graphics array feature connector; and analog red, green and blue data from the video graphics array connector. The earlier overlay controller used the pixel data for a color display, and generates the analog red, green and blue data. The analog multiplexer received the analog red, green and blue data from the overlay controller and other analog red, green and blue data from the video graphics array connector. The analog red, green and blue data signal from the analog multiplexer were applied to a monitor drive through a monitor connector.

I have found that in the earlier arrangement however, connectors for analog red, green and blue data were placed on the back side of a computer, thereby causing an inconvenience when installing a computer system. The connectors for analog red, green and blue data are connected to the computer system by using additional cables, thereby causing the possibility of a loss. Furthermore, I have also noticed that there are many connectors with the same shape on the back side is of the computer, thereby leading to misinsertion.

A function of a display data channel (DDC) is to transmit and receive commands between a video graphics array board and a monitor. When an overlay board is inserted between a conventional video graphics array board and a monitor, and a signal necessary for a display data channel is changed, the display data channel may not be able to operate.

Exemplary efforts representation of contemporary practice with computer systems having overlay features include U.S. Pat. No. 5,546,518 to Blossom et al. entitled *System And Method For Composing A Display Frame Of Multiple Layered Graphic Sprites,* U.S. Pat. No. 5,254,984 to Wakeland entitled *video graphics array Controller For Displaying Images Having Selective Components From Multiple Image Planes,* U.S. Pat. No. 5,093,798 to Kita entitled *Image Processing System,* U.S. Pat. No. 4,954,970 to Walker et al. entitled *Video Overlay Image Processing Apparatus,* U.S. Pat. No. 4,942,391 to Kikuta entitled *Picture Information Composite System,* U.S. Pat. No. 4,878,181 to MacKenna et al. entitled *Video Display Controller For Expanding Monochrome Data To Programmable foreground And Background Color Image Data,* U.S. Pat. No. 4,855,831 to Miyamoto et al. entitled *Video Signal Processing Apparatus,* and U.S. Pat. No. 4,800,423 to Appiano et al. entitled *Interface Module For Superimposing alphanumeric Characters Upon RGB Video Signals.* It is may observation however that the art represented by these exemplars fail to appreciate either the difficulties caused by contemporary practice in the art, or the need for an improvement in the connectors for graphics controllers.

SUMMARY OF THE INVENTION

An object of the present invention is to provide an improved feature connector for transmission and reception of both digital and analog data.

It is another object to provide an enhanced feature connector for an overlay board which transmits and receives the digital data and the analog data using one connector.

In order to achieve this object, the present invention includes: an enhanced feature connector for receiving both video graphics array digital feature data and analog red, green and blue data from a video graphics array board; a video graphics array board for outputting a video signal to an output unit having a graphics control large scale integration unit including a video graphics array unit which is requisite for generation of a video signal transmitted to a video display through cables; and an overlay board for overlaying another video signal on a current operating program.

The overlay board according to the present invention may be constructed with an enhanced feature connector for receiving both video graphics array digital feature data and analog red, green and blue data from a video graphics array board; an overlay controller for receiving digital data such as pixel data, pixel clock, horizontal synchronization, and vertical synchronization from a digital feature connector of the enhanced feature connector, converting the digital data into analog red, green and blue data, and generating an overlay red, green and blue data; an analog multiplexer for sequentially selecting both an input signal of analog red, green and blue data of the overlay controller and an input signal of analog red, green and blue data of a video graphics array board (not shown), dividing the input signals, and selecting a signal corresponding to each input signal; and a monitor connector for receiving output data from both the analog multiplexer and the enhanced feature connector, and for outputting the output data to a monitor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The preferred embodiments of the present invention will become apparent from a study of the following detailed description, when viewed in light of the accompanying drawings.

Figure 1:
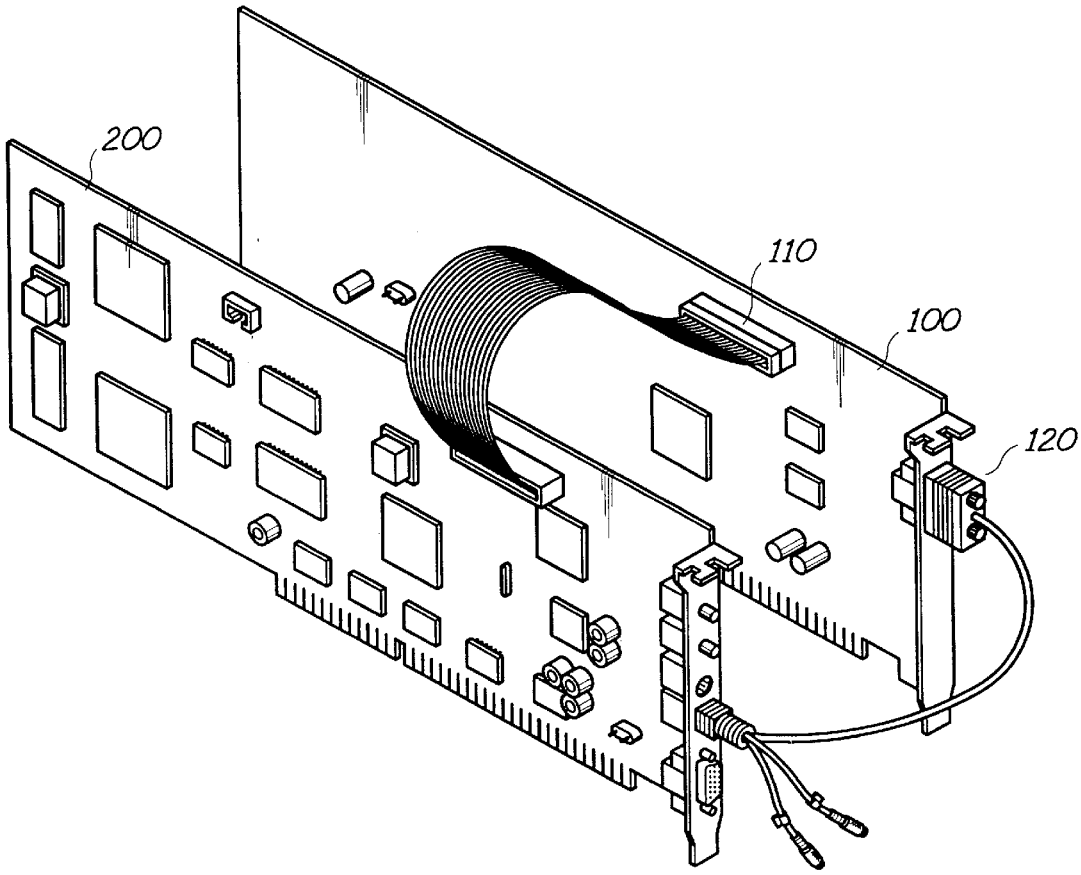
FIG. 1 is a perspective view showing an earlier connection between a feature connector and an overlay board.

FIG. 1 is a perspective view showing an earlier connection between a feature connector and an overlay board. As shown in FIG. 1, the earlier connection of a feature connector and an overlay board includes: a video graphics array board 100 for outputting a video signal to an output unit having a graphics control large scale integration unit including a video graphics array unit which is requisite for generation of a video signal transmitted to a video display through cables; a feature connector 110 for transmitting and receiving a video graphics array digital video signal which is generally used to overlay other signals; an overlay board 200 for overlaying another video signal on a current operating program; and an analog connector 120 for transmitting analog video R(red), G(green), and B(blue) data signals outputted from the video graphics array board.

The earlier overlay board 200 receives digital pixel data from the video graphics array feature connector 110 of the video graphics array board 100 as an input and receives an analog video red, green and blue data signal from the video graphics array monitor connector 120 as an input. The overlay board 200 receives both the digital pixel data and the red, green and blue data signal, and generates a signal mixed by an internal circuit, and outputs the mixed signal to a monitor.

Table 1 describes a pin definition of the analog red, green and blue data of a 15-pin D-SUB connector.

<TABLE 1>

| Pin Number | Standard video graphics array | DDC1 Host | DDC2 Host | DDC3 Host |
|---|---|---|---|---|
| 1 | Red Video | Red Video | Red Video | Red Video |
| 2 | Green Video | Green Video | Green Video | Green Video |
| 3 | Blue video | Blue Video | Blue Video | Blue Video |
| 4 | Monitor ID Bit 2 | Monitor ID Bit 2 | Monitor ID Bit 2 | Optional |
| 5 | Test (Ground) | DDC Return* | DDC Return* | DDC Return* |
| 6 | Red Video Return | Red Video Return | Red Video Return | Red Video Return |
| 7 | Green Video Return | Green Video Return | Green Video Return | Green Video Return |
| 8 | Blue Video Return | Blue Video Return | Blue Video Return | Blue Video Return |
| 9 | No Connection (Mechanical Key) | +5 V Supply (Optional) | +5 V Supply (Optional) | +5 V Supply (Optional) |
| 10 | Sync Return | Sync Return | Sync Return | Sync Return |
| 11 | Monitor ID Bit 0 | Monitor ID Bit 0 | Monitor ID Bit 0 | Optional |
| 12 | Monitor ID Bit 1 | Data from Display | Bi-directional Data (SDA) | Bi-directional Data (SDA) |
| 13 | Horizontal Synchronization | Horizontal Synchronization | Horizontal Synchronization | Horizontal Synchronization |
| 14 | Vertical Synchronization | Vertical Synchronization | Vertical Synchronization | Vertical Synchronization |

<TABLE 1>-continued

| Pin Number | Standard video graphics array | DDC1 Host | DDC2 Host | DDC3 Host |
|---|---|---|---|---|
| 15 | Monitor ID Bit 3 | Monitor ID Bit 3 | Data Clock SCL | Data Clock SCL |

Table 2 describes a pin definition of a feature connector.

<TABLE 2>

| PIN # | DEFINITION |
|---|---|
| 1, 3, 5, 15, 17, 19, 21, 26, | GROUND |
| 7, 9, 11, 13, 23, 25 | N.C. (No Connection) |
| 2, 4, 6, 8, 10, 12, 14, 16 | PIXEL DATA #0–#7 |
| 18 | PIXEL CLOCK |
| 20 | FCBLANK |
| 22 | FCHSYNC |
| 24 | FCVSYNC |

Figure 2:
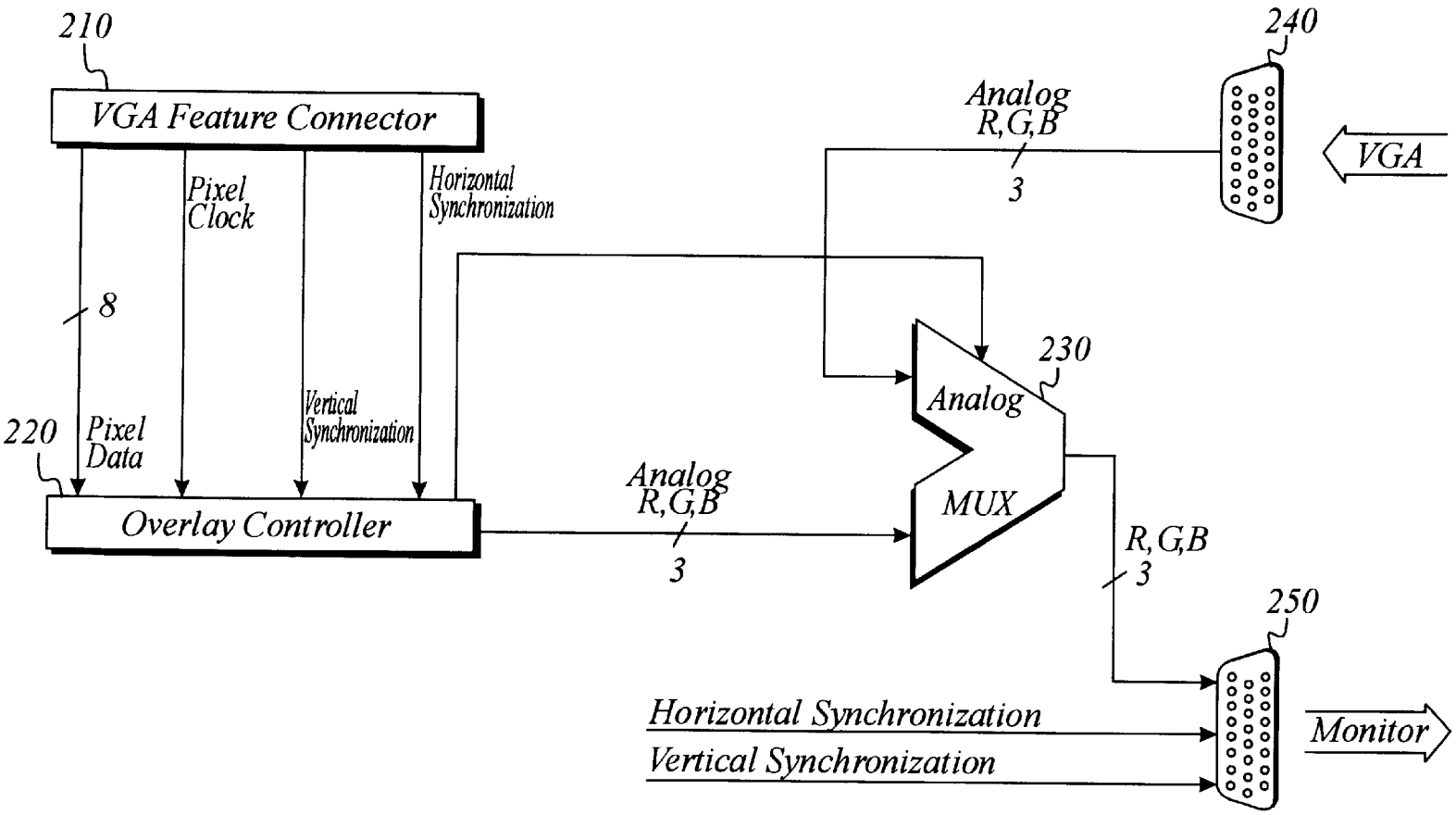
FIG. 2 is a block diagram of an earlier overlay board.

FIG. 2 is an internal block diagram of an earlier overlay board. As shown in FIG. 2, the earlier overlay board includes: a feature connector 210 for transmitting and receiving a video graphics array digital video signal used for overlaying other signals; a connector 240 for receiving analog red, green and blue data from a video graphics array board (not shown) as an input; an overlay controller 220 for receiving digital signals such as pixel data, pixel clock, horizontal synchronization, and vertical synchronization and converting the digital signals into analog red, green and blue data in order to overlay video signals by loading plural display windows; an analog multiplexer (hereinafter referred to as an analog multiplexer) 230 for sequentially selecting both an input signal of analog red, green and blue data of the overlay controller 220 and an input signal of analog red, green and blue data of a video graphics array board (not shown), dividing the input signals, and selecting a signal corresponding to each input signal; and a connector 250 for transmitting output data from the analog multiplexer 230 to a monitor (not shown).

The earlier overlay board receives video graphics array data from a video graphics array board, combines the video graphics array data with the conventional overlay board's signal and finally outputs the combined data to a monitor. There are two kinds of paths for receiving a signal from the video graphics array board: digital signals such as a pixel data, pixel clock, horizontal synchronization signal, and vertical synchronization signal from the video graphics array feature connector 210; and analog red, green and blue data from the video graphics array connector 240. The overlay controller 220 uses the pixel data for a color display, and generates the analog red, green and blue data. The analog multiplexer 230 receives the analog red, green and blue data from the overlay controller 220 and other analog red, green and blue data from the video graphics array connector 240. The analog red, green and blue data signal from the analog multiplexer 230 are outputted to a monitor (not shown) through a monitor connector 250.

Figure 3:
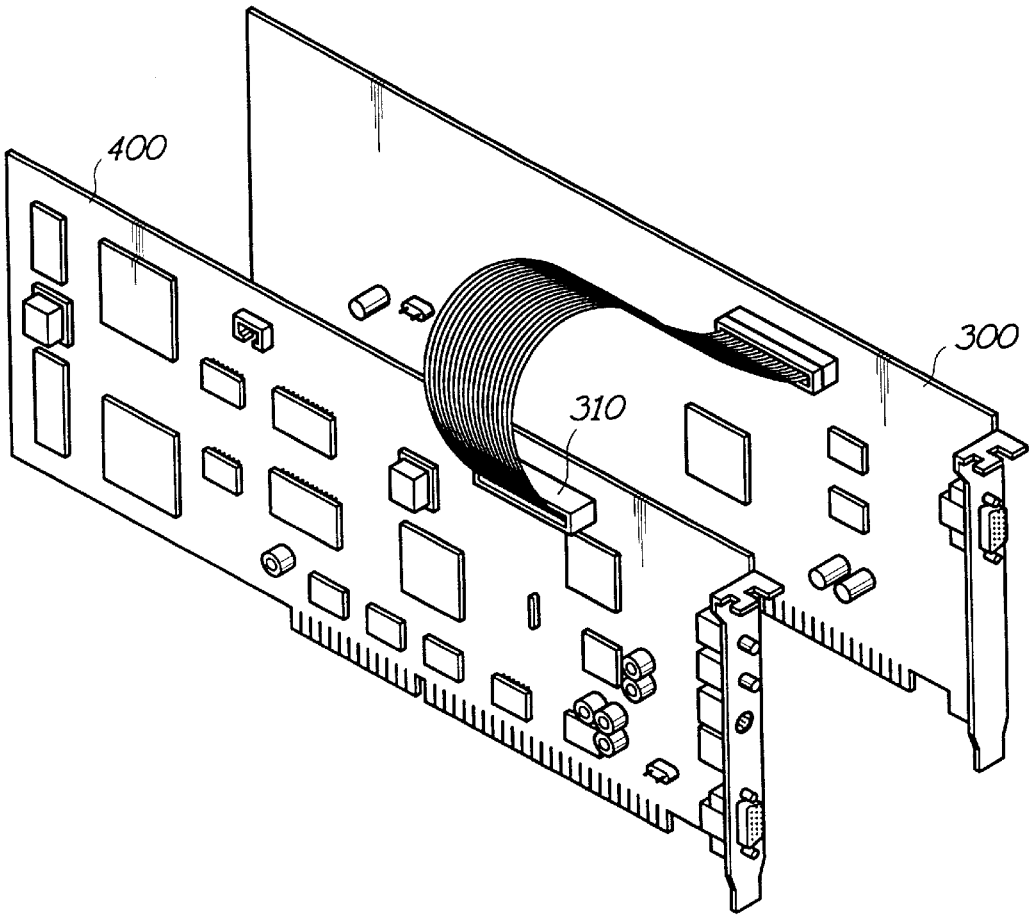
FIG. 3 is a perspective view showing a connection between a feature connector and an overlay board in accordance with a preferred embodiment of the present invention.

As shown in FIG. 3, a perspective view showing a connection between a feature connector and an overlay board consists of: a video graphics array board 300 for outputting a video signal to an output unit as a graphics control large scale integration unit including a video graphics array unit which is requisite for the generation of a video signal transmitted to a video display through cables; an enhanced feature connector 310 for receiving both video graphics array digital feature data and analog red, green and blue data from the video graphics array board; and an overlay board 400 for overlaying another video signal on a current operating program.

Figure 4:
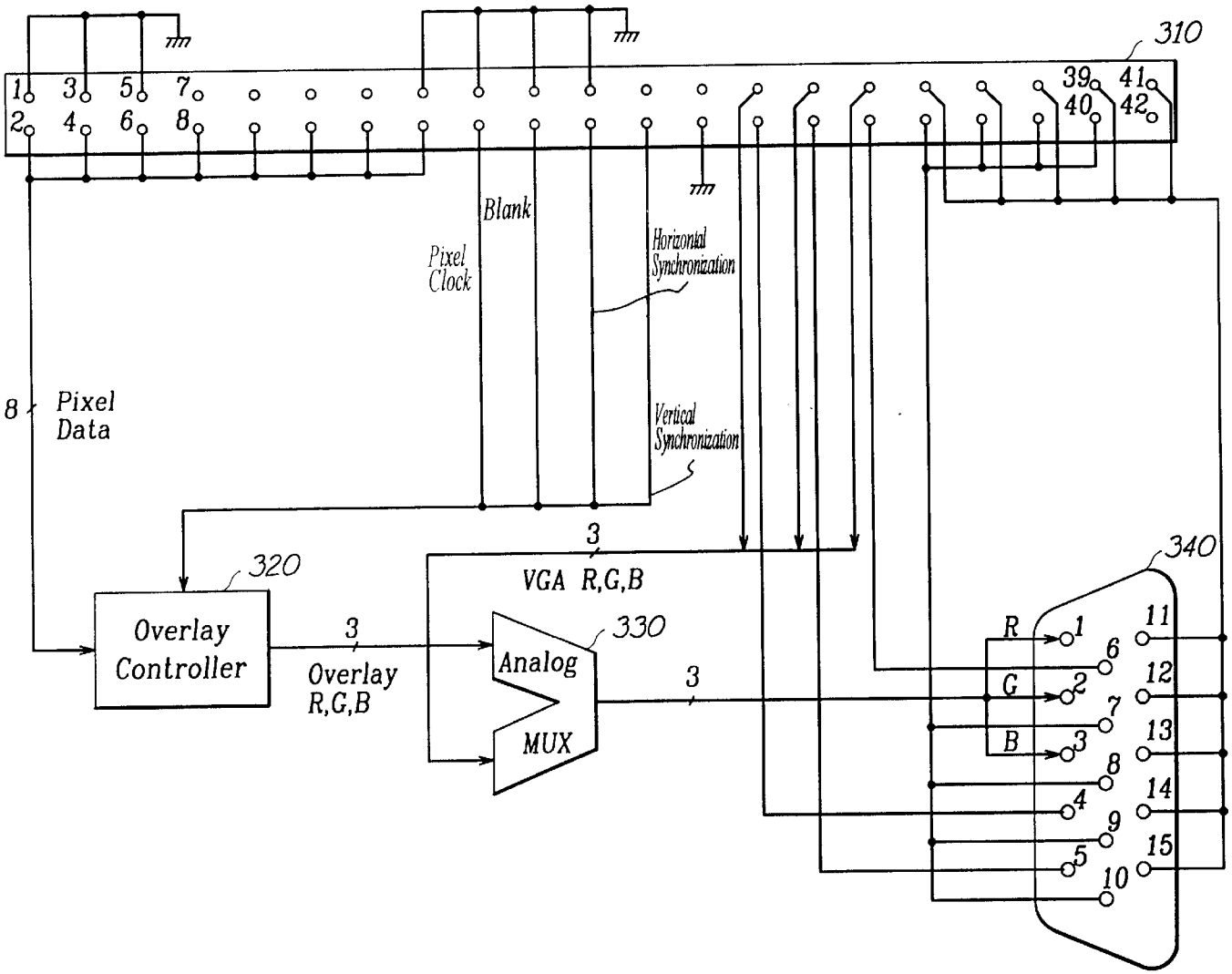
FIG. 4 is a block diagram of an overlay board in accordance with a preferred embodiment of the present invention.

As shown in FIG. 4, the overlay board 400 consists of: an enhanced feature connector 310 for receiving both video graphics array digital feature data and analog red, green and blue data from the video graphics array board 300; an overlay controller 320 for receiving digital data such as pixel data, pixel clock, horizontal synchronization, and vertical synchronization from a digital feature connector portion of the enhanced feature connector 310, converting the digital data into analog red, green and blue data, and generating overlay red, green and blue data; an analog multiplexer 330 for sequentially selecting both an input signal of analog red, green and blue data of the overlay controller 320 and an input signal of analog red, green and blue data of the video graphics array board 300, dividing the input signals, and selecting a signal corresponding to each input signal; and a monitor connector 340 for receiving output data from both the analog multiplexer 330 and the enhanced feature connector 310, and for outputting the output data to a monitor (not shown).

The overlay board 400 receives both video graphics array digital feature data and analog red, green and blue data from the video graphics array board 300 through the enhanced feature connector. The overlay controller 320 receives digital data such as pixel data, pixel clock, horizontal synchronization, and vertical synchronization from the digital feature connector of the enhanced feature connector 310, converting the digital data into overlay red, green and blue data, and thereby generating the overlay red, green and blue data. The analog multiplexer 330 receives the overlay red, green and blue data from the overlay controller 320 and the analog red, green and blue data from an analog connector portion of the enhanced feature connector 310 as an input, sequentially selects the input signals which are the overlay red, green and blue data and the analog red, green and blue data, divides the input signals, and selects a signal corresponding to each input signal. The monitor connector 340 receives an output data from both the analog multiplexer 330 and the enhanced feature connector 310 as an input, and outputs the output data to a monitor.

Figure 5:
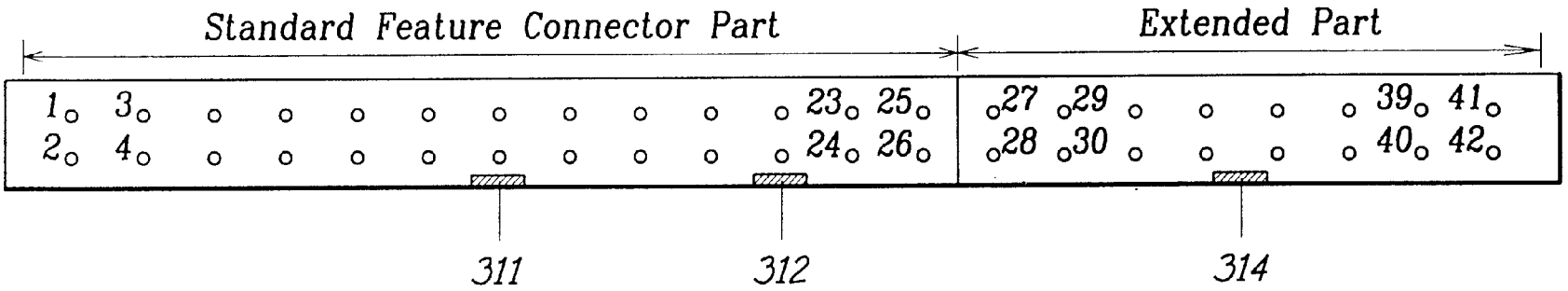
FIG. 5 shows a layout of an enhanced feature connector pins in accordance with a preferred embodiment of the present invention.

As shown in FIG. 5, the enhanced feature connector 310 has a key lock 3 1 1 in the center of the standard feature connector part for setting up the direction of the connector in the part of the s digital feature connector, a key lock 312 in the center of the enhanced connector for setting up the direction of the connector in the part of the analog data, and a key lock 314 in the center of the extended part of the enhanced feature connector for setting up the direction of the connector when the enhanced feature connector is linked. As a result, an enhanced feature connector for an overlay board transmits and receives the digital data from a video graphics array feature connector and the analog data from a video graphics array connector by using one connector.

It is understood that various other modifications will be apparent to and can be readily made by those skilled in the art without departing from the scope and spirit of this invention. Accordingly, it is not intended that the scope of the claims appended hereto be limited to the description set forth above, but rather that the claims be construed as encompassing all the features of patentable novelty that reside in the present invention, including all features that would be treated as equivalents thereof by those skilled in the art to which this invention pertains.

What is claimed is:

1. An overlay board, comprising:

an enhanced feature connector for receiving both video graphics array digital feature data and analog red, greens and blue data from a video graphics array board;

an overlay controller for receiving digital data from a digital feature connector portion of said enhanced feature connector, converting said digital data into analog red green, and blue data, and for generating overlay red green, and blue data;

an analog multiplexer for sequentially selecting both an input signal of analog red, green, and blue data of said overlay controller and an input signal of analog red, green, and blue data of said video graphic array board dividing said input signals, and selecting a signal corresponding to each input signal; and a monitor connector for receiving output data from both said analog multiplexer and said enhanced feature connector and for outputting said output data to a monitor;

said enhanced feature connector comprising:

a key lock disposed in a standard feature connector portion for setting up the direction of the connector in the digital feature portion of the enhanced feature connector;

a key lock disposed in the enhanced feature connector for setting up the direction of the connector in an analog data portion of the enhanced feature connector; and a key lock disposed in an extended part of the enhanced feature connector for setting up the direction of the connector when the enhanced feature connector is linked.

2. The overlay board as claimed in claim 1, the key lock of the standard feature connector portion being disposed in the center of the standard feature connector portion and the key lock of the enhanced feature connector being disposed in the center of the enhanced feature connector and the key lock of the extended part of the enhanced feature connector being disposed in the center of the extended part of the enhanced feature connector.

3. An enhanced feature connector for connecting an overlay board to a video graphics array board, comprising:

a multipin electrical connector for receiving video graphics array digital feature data and analog red, green, and blue data from the video graphics array board and for outputting the received digital feature data to an overlay controller of the overlay board and for outputting the analog red, green, and blue data to both an analog multiplexer of the overlay board and a monitor connector of the overlay board;

a key lock disposed in a standard feature connector portion for setting up the direction of the connector in the digital feature portion of the enhanced feature connector;

a key lock disposed in the enhanced feature connector for setting up the direction of the connector in an analog data portion of the enhanced feature connector; and a key lock disposed in an extended part of the enhanced feature connector for setting up the direction of the connector when the enhanced feature connector is linked.

4. The enhanced feature connector as claimed in claim 3, the key lock of the standard feature connector portion being disposed in the center of the standard feature connector portion and the key lock of the enhanced feature connector being disposed in the center of the enhanced feature connector and the key lock of the extended part of the enhanced feature connector being disposed in the center of the extended part of the enhanced feature connector.

5. A method of connecting an overlay board to a video graphics array board, comprising:

providing a multipin electrical enhanced feature connector for receiving video graphics array digital feature data and analog red, green, and blue data from the video graphics array board and for outputting the received digital feature data to an overlay controller of the overlay board and for outputting the analog red, green, and blue data to both an analog multiplexer of the overlay board and a monitor connector of the overlay board;

providing a key lock disposed in a standard feature connector portion for setting up the direction of the connector in a digital feature portion of the enhanced feature connector;

providing a key lock disposed in the enhanced feature connector for setting up the direction of the connector in an analog data portion of the enhanced feature connector; and providing a key lock disposed in an extended part of the enhanced feature connector for setting up the direction of the connector when the enhanced feature connector is linked.

6. The method as claimed in claim 5, further comprising disposing the key lock of the standard feature connector portion in the center thereof and disposing the key lock of the enhanced feature connector in the center thereof and disposing the key lock of the extended part of the enhanced feature connector in the center thereof.

* * * * *